US006244836B1

(12) United States Patent
Jordan et al.

(10) Patent No.: US 6,244,836 B1
(45) Date of Patent: Jun. 12, 2001

(54) WELL PUMP ACTUATED BY NATURAL GAS

(76) Inventors: Robert A. Jordan, 117 1/2 Jordan St., Bloomfield, NM (US) 87413; William D. Nystrom, 3108 Sunset, Farmington, NM (US) 87412

( * ) Notice: Subject to any disclaimer, the term of this patent is extended or adjusted under 35 U.S.C. 154(b) by 0 days.

(21) Appl. No.: 09/498,591

(22) Filed: Feb. 4, 2000

(51) Int. Cl.[7] ..... F04B 17/00

(52) U.S. Cl. ..... 417/399; 417/384; 91/171

(58) Field of Search ..... 417/398, 379, 417/384, 399, 401; 91/131, 171, 218, 335, 336; 60/399, 406; 166/72, 73, 105

(56) References Cited

U.S. PATENT DOCUMENTS

| | | | | |
|---|---|---|---|---|
| 993,707 | * | 5/1911 | Murphy | 417/398 |
| 3,614,271 | * | 10/1971 | Muchnik et al. | 417/379 |
| 3,858,688 | * | 1/1975 | Galloway | 91/171 X |
| 4,545,737 | * | 10/1985 | Stanton | 417/399 X |
| 5,012,898 | * | 5/1991 | Tsymberov | 60/399 X |

OTHER PUBLICATIONS

Brochure titled "PNEULIFT," by Maranatha Industries (undated).

* cited by examiner

*Primary Examiner*—Charles G. Freay
*Assistant Examiner*—David J. Torrente
(74) *Attorney, Agent, or Firm*—Ray G. Wilson

(57) ABSTRACT

A pneumatic pump pumps liquids from natural gas wells. First and second pneumatic rams have first and second pistons housed in first and second cylinders with a lifting beam connecting the first and second pistons above the first and second cylinders and connectable to sucker rods for lifting liquids from a well. First and second gas connections are provided beneath the first and second pistons in the first and second cylinders. First valves are connected to the first and second gas connections to introduce compressed gas beneath the first and second pistons for raising the lifting beam during an upstroke of the sucker rods and a first control valve regulates the up-stroke rate of the lifting beam. Second valves are connected to the first and second gas connections to exhaust gas beneath the first and second pistons for lowering the lifting beam during a down-stroke of the sucker rods and a second control valve regulates the down-stroke rate of the lifting beam.

4 Claims, 3 Drawing Sheets

WELL PUMP ACTUATED BY NATURAL GAS

FIELD OF THE INVENTION

The present invention relates generally to the production of hydrocarbons and, more particularly, to pumping devices for removing liquids from a borehole.

BACKGROUND OF THE INVENTION

Natural gas formations are frequently found in combination with oil and/or water formations that are open to the production piping. If the fluid head produced by oil or water becomes too great, the flow of natural gas from the well is reduced or stopped. Accordingly, the fluid must be removed from the well in order to maintain a viable flow of natural gas.

Conventional fluid pumps for use in gas and oil wells use a rocking arm-type pump that raises and lowers a string of sucker rods to move the fluid from the well. Such pumps may be powered by electrical motors if electrical power is available at a well site or internal combustion engines may be used to run a generator for producing electrical power. In either case, there is a large energy expense associated with removing fluids from the well.

A pneumatic pump unit (Pneulift®, by Maranatha Industries) has been developed to use natural gas as a lifting medium. Compressed gas is applied on both an up stroke and a down stroke to drive ram cylinders for removing liquids from natural gas wells. A complex system, including two separate pneumatic units and a stored gas supply, is provided to control the rate of the down-stroke of the unit.

In accordance with the present invention, pressurized natural gas that is available at or near a well site is used to operate a pump where the gas is returned to the distribution network on each pump cycle. Simple valve systems control the operating speed of the unit.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention is directed to a pneumatic pump for pumping liquids from natural gas wells. First and second pneumatic rams have first and second pistons housed in first and second cylinders with a lifting beam connecting the first and second pistons above the first and second cylinders and connectable to sucker rods for lifting liquids from a well. First and second gas connections are provided beneath the first and second pistons in the first and second cylinders. First valves are connected to the first and second gas connections to introduce compressed gas beneath the first and second pistons for raising the lifting beam during an up-stroke of the sucker rods and a first control valve regulates the up-stroke rate of the lifting beam. Second valves are connected to the first and second gas connections to exhaust gas beneath the first and second pistons for lowering the lifting beam during a down-stroke of the sucker rods and a second control valve regulates the down-stroke rate of the lifting beam.

BRIEF DESCRIPTION OF THE DRAWINGS

The accompanying drawings, which are incorporated in and form a part of the specification, illustrate the present invention and, together with the description, serve to explain the principles of the invention. In the drawings.

DETAILED DESCRIPTION

Figure 1:
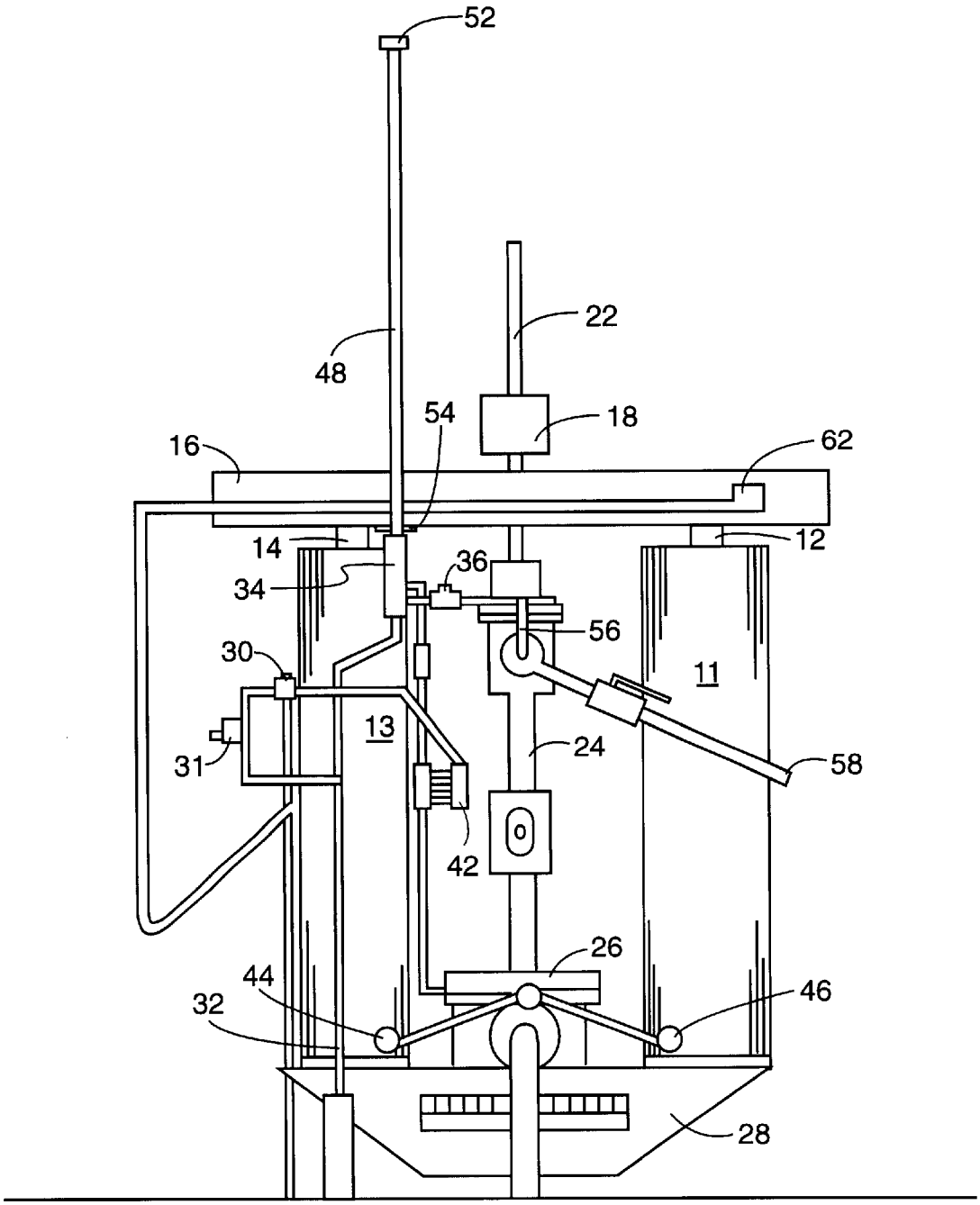
FIG. 1 is a front view of a pump assembly according to one embodiment of the present invention.
Figure 2:
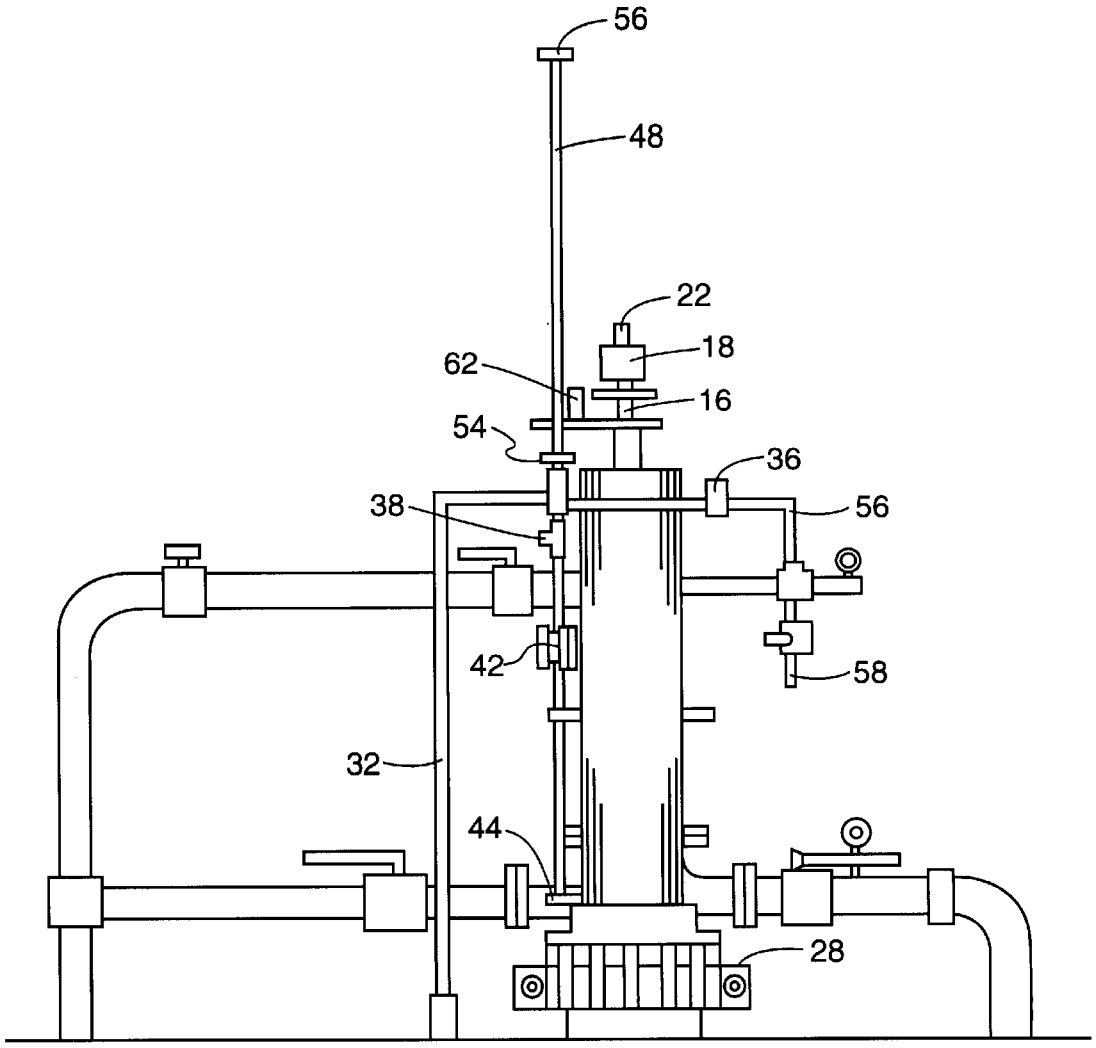
FIG. 2 is a side view of the pump assembly shown in FIG. 1.

FIGS. 1 and 2 depict, respectively, front and side views of a pneumatic pumping unit according to one embodiment of the present invention. First and second pneumatic piston rams with operating pistons 12, 14 and cylindrical housings 11, 13, are mounted beneath lifting beam 16 for raising and lowering beam 16. Lifting beam 16 engages flange assembly 18, which engages sucker rod 22. Flange assembly 18 may be formed integral with extending sucker rod 22 or may be formed from a number of conventional combinations of bolted flanges, collars, and the like. Sucker rod 22 is the extending end of a sucker rod assembly that extends through gas well production stack 24 and within a borehole casing (not shown) for pumping liquids from within the borehole. Production stack 24 is mounted on wellhead casing flange 26. Pneumatic pistons 12, 14 are raised and lowered to reciprocally move beam 16 and sucker rod 22 for pumping liquids from the well tubing.

Pneumatic pistons 12, 14 and the sucker rods 22 are supported by mounting bracket 28, which is supported by casing flange 26. Mounting bracket 28 may be formed from a one-half inch thick steel plate that sits atop casing flange 26. In a preferred design, a four-inch by quarter-inch flat strap is made in a circle and connected at the bottom of the casing on opposing sides by half-inch bolts. From the top plate to the bottom strap is a gusset every six inches made from threeeighth inch plate.

Lifting beam 16 may be formed of two lengths of six-inch steel channels approximately forty-eight inches long that are bolted back-to-back. As further explained below, beam 16 also contains a level switch 62 with electrical circuitry and relays to actuate an emergency shutdown of the pump.

To operate the pump, compressed natural gas is supplied through an inlet line 32 to three-way valve 34. Three-way valve 34 supplies compressed gas from a pipeline at, e.g., a pressure of 50–150 psig through control valve 38 and motor valve 42 to inlets 44, 46 for rams 14, 12, respectively. Control valve 38, which may be a choke valve or other conventional gas flow regulator, is adjusted to control the upstroke speed of the pump. Motor valve 42 is an emergency shut-down device, as explained below.

During an up-stroke, compressed gas is supplied to inlets 44, 46 and rams 12, 14 move beam 16 upward. At the desired length of an up-stroke, beam 16 engages flange 52 on actuating rod 48 and moves actuating rod 48 to switch three-way valve 34 to an exhaust position. In the exhaust position, three-way valve 34 shuts-off the input supply line 32 and connects input ports 44, 46 through motor valve 42, control valve 38 and through control valve 36 and exhaust line 56 to the well tubing and then to the gas delivery line 58. The average well pressure for the exhaust is about 10–40 psig. Control valve 36 which may be a choke valve or other conventional gas flow regulator, is adjustable to control the speed at which the sucker rod assembly travels on the downward stroke in the well tubing.

At the bottom of the exhaust stroke, beam 16 engages flange 54 on rod 48 to return three-way valve 34 to the gas supply and connect compressed gas line 32 to pistons 12, 14 for another upward cycle.

In one feature of the present invention, a level switch assembly 62 is carried on beam 16. If the differential movement of piston 12 or piston 14 becomes too large, beam 16 becomes unleveled, which could lead to a pump failure or damage to the sucker rod assembly. If this happens, level switch assembly 62 trips a switch to actuate solenoid valve 30. When solenoid valve 30 open, pressurized gas from input line 32 is supplied to motor valve 42 through regulator valve 31. Motor valve 42 closes to prevent gas flow to cylinders 11 and 13 and stop movement of pistons 12 and 14.

Figure 3:
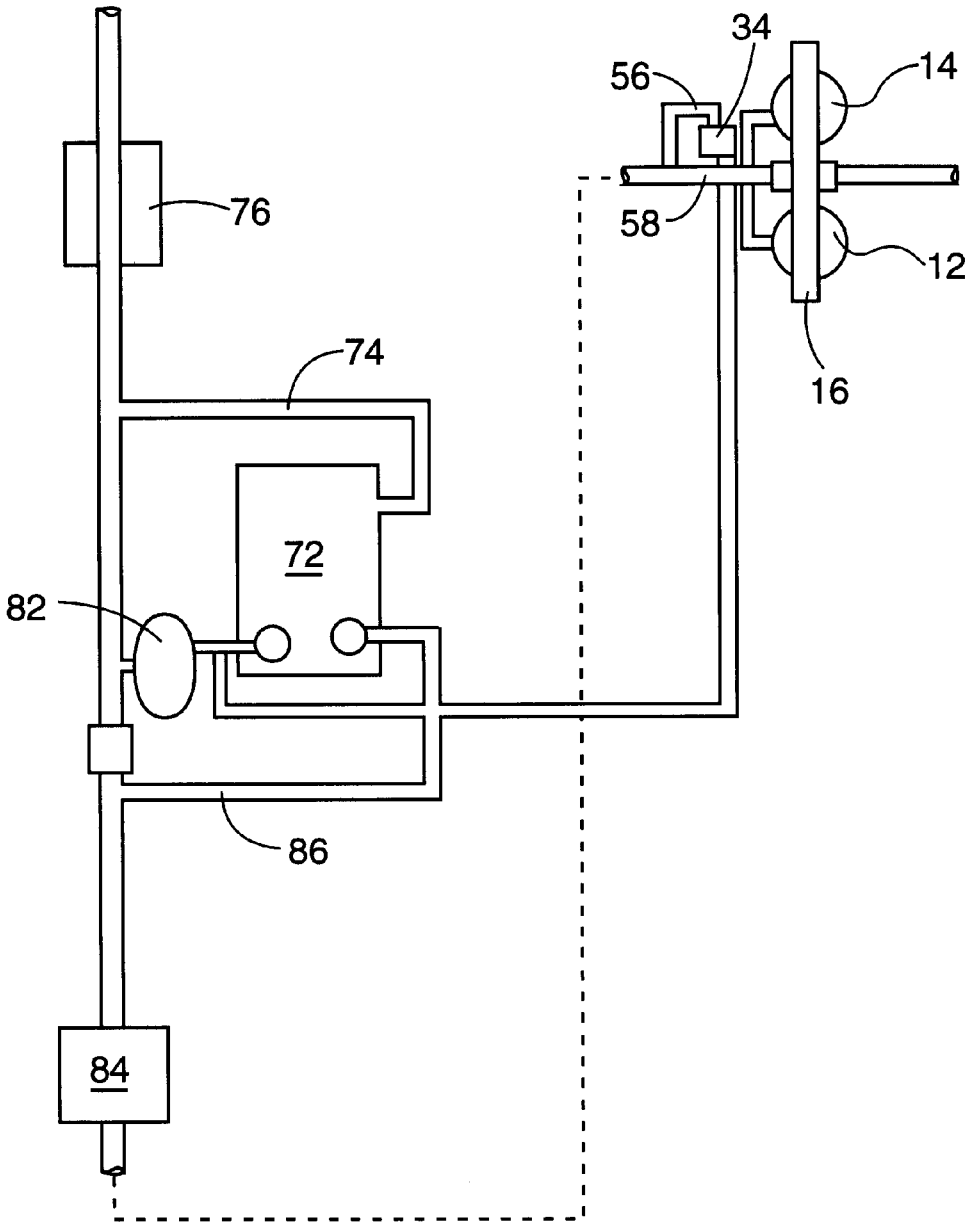
FIG. 3 schematically the connection of the pump assembly shown in FIGS. 1 and 2 with a compressor station for delivering natural gas to a pipeline.

As shown in FIG. 3, the pumping unit is actuated by natural gas that is compressed in accordance with conventional natural gas production delivery to a pipeline. Natural gas from a gas well head is delivered to separator 84 to remove liquids from the natural gas. The dry gas is input through line 86 to the suction line of compressor 72 for delivery at high pressure to a delivery pipeline through meter run 76. A portion of the compressed gas is made available to the pump assembly through supply line 32 and three-way valve 34 to pistons 12, 14 to raise beam 16 and pump fluids from the well. In an exhaust cycle, gas is returned through threeway valve 34, exhaust line 56, and the well bore for delivery with normal production gas through line 58 to separator 82 and back to compressor 72.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A pneumatic pump for pumping liquids from natural gas wells, comprising:

first and second pneumatic rams having first and second pistons housed in first and second cylinders;

a lifting beam connecting the first and second pistons above the first and second cylinders and connectable to sucker rods for lifting liquids from a well;

first and second gas connections beneath the first and second pistons in the first and second cylinders;

first valves connected to the first and second gas connections to introduce compressed gas beneath the first and second pistons for raising the lifting beam during an up-stroke of the sucker rods and including a first control valve for regulating the lifting rate of the up-stroke beam; and second valves connected to the first and second gas connections to exhaust gas beneath the first and second pistons for lowering the lifting beam during a down-stroke of the sucker rods and including a second control valve for regulating the down-stroke rate of the lifting beam.

2. A pneumatic pump according to claim 1, wherein the first and second valves share a common cut-off valve for stopping movement of the lifting beam during an emergency.

3. A pneumatic pump according to claim 2, further including a level switch assembly on the lifting beam to detect differential movement of the first and second pistons and actuate the cut-off valve when the differential movement exceeds a preselected limit.

4. A pneumatic pump according to claim 1, further including a natural gas compressor station having a gas compressor for delivering compressed natural gas to a pipeline, where the first valves are connected to receive compressed natural gas from the compressor and the second valves are connected to return exhaust gas to the natural gas well for delivery to the compressor.

* * * * *